US005167554A

United States Patent [19]

Tager et al.

[11] Patent Number: 5,167,554

[45] Date of Patent: Dec. 1, 1992

[54] INFLATABLE HUMAN SUPPORT STRUCTURE WITH LIQUID SQUIRTER

[75] Inventors: Leon H. Tager, San Carlos; William R. Storey, Sunnyvale, both of Calif.

[73] Assignee: Poolmaster, Inc., Sacramento, Calif.

[21] Appl. No.: 683,120

[22] Filed: Apr. 3, 1991

Related U.S. Application Data

[63] Continuation of Ser. No. 410,916, Sep. 22, 1989, abandoned.

[51] Int. Cl.[5] ..... B63C 9/08

[52] U.S. Cl. ..... 441/131; 222/79; 441/129

[58] Field of Search ..... 440/39, 27; 441/40, 441/129-132; 222/78, 79, 175, 192; 114/345; 272/1 B, 32, 33 R

[56] References Cited

U.S. PATENT DOCUMENTS

| | | | |
|---|---|---|---|
| 543,210 | 7/1895 | Jessup | 114/123 X |
| 1,503,624 | 8/1924 | Bowman et al. | 441/132 |
| 2,494,804 | 1/1950 | Gabriel | 114/123 |
| 2,794,191 | 6/1957 | Gaskovitz | 114/123 |
| 2,801,850 | 8/1957 | Yount | 272/1 B |
| 3,339,516 | 9/1967 | Lenci | 440/39 |
| 3,384,047 | 5/1968 | Remley | 440/39 |
| 3,823,847 | 7/1974 | Ware | 222/79 |
| 4,613,311 | 9/1986 | Wood | 441/131 |
| 4,708,676 | 11/1987 | Lin | 440/27 X |

*Primary Examiner*—Edwin L. Swinehart
*Attorney, Agent, or Firm*—Flehr, Hohbach, Test, Albritton & Herbert

[57] ABSTRACT

A device for use by a human in a body of water comprising a support structure having a buoyancy in water sufficient to support a human on the body of water. A water squirter is carried by the support structure and has piping means adapted to be disposed in the body of water in a region in the vicinity of the support structure. The water squirter includes a member adapted to be engaged by the human for operation of the same. The water squirter is positioned on the support structure so that the water squirter can be engaged and operated by the human while the human is being supported on the body of water by the support structure so that squirts of water can be directed from the water squirter at a location which is above the surface of the water.

13 Claims, 3 Drawing Sheets

INFLATABLE HUMAN SUPPORT STRUCTURE WITH LIQUID SQUIRTER

This is a continuation of application Ser. No. 410,916 filed Sept. 22, 1989, now abandoned.

This invention relates to an inflatable human support structure with liquid squirter.

Inflatable rafts, tubes and the like have heretofore been provided for supporting humans upon a body of water. In order to enhance the use of such devices, and particularly in pools by children, there is a need for devices which can be utilized in conjunction therewith to make the use of such devices more satisfying, i.e., more fun to use and to provide play.

In general, it is an object of the present invention to provide a human support structure with liquid or water squirter which can be utilized on a body of water.

Another object of the invention is to provide an inflatable structure of the above character which can be inflated and deflated.

Another object of the invention is to provide a support structure which can take various forms.

Another object of the invention is to provide a support structure of the above character in which the support structure is circular.

Another object of the invention is to provide a support structure of the above character in the form of a raft.

Another object of the invention is to provide a support structure of the above character in which the liquid squirter is readily accessible to a human carried by the support structure for operation of the same.

Another object of the invention is to provide a support structure of the above character in which the liquid squirter is utilized for squirting water from the body of the water in which the support structure floats.

Another object of the invention is to provide a support structure of the above character in which the support structure is particularly adapted to have a human seated therein.

Another object of the invention is to provide a support structure of the above character in which the support structure is particularly adapted to support a human in a lying down position.

Another object of the invention is to provide a support structure with liquid squirter of the above character in which various types of liquid squirters can be utilized.

Additional objects and features of the invention will appear from the following description in which the preferred embodiments are set forth in detail in conjunction with the accompanying drawings.

Figure 1:
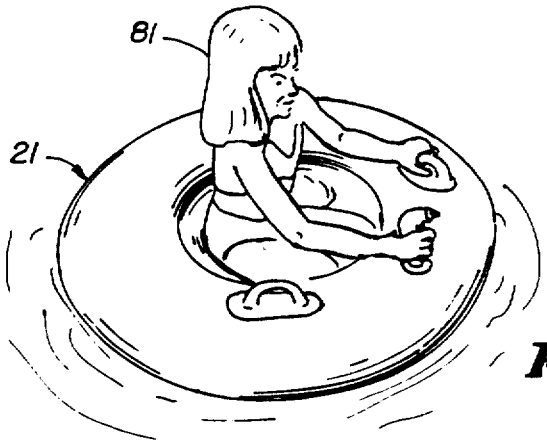
FIG. 1 is a perspective view of an inflatable human support device with liquid squirter with a human occupant shown therein.

In general, the device for use by a human in a body of water is comprised of a support structure having a buoyancy in water sufficient to support a human in a body of water. A water squirter is carried by the support structure and has piping means adapted to be disposed in the body of water in a region in the vicinity of the support structure and also including a member adapted to be engaged by the human for operation of the same. The water squirter is positioned on the support structure so that the water squirter can be engaged and operated by the human while the human is being supported on the body of water by the support structure to direct squirts of water from the support structure at a position which is above the surface of the body of water. The support structure can take the form of a tubular member which is provided with a seat with an opening adjacent the seat through which the legs can extend and in which the human can be positioned in a seating position. Another embodiment of the support structure can be in the form of a raft having a flat surface upon which the human can lie.

More in particular, the device 21 for use by a human in a body of water consists of a support structure 22 having a buoyancy in water sufficient to support a human on the body of water. The support structure 22 is formed of materials which are utilized in inflatables for use in swimming pools and the like. It is well known to those skilled in the art that such inflatables can be formed of rubber, plastic and other materials. One material found to be particularly satisfactory is polyvinyl chloride (PVC) which is provided in flexible sheet form of a suitable thickness, as for example, 14 gauge, and which can be readily heat sealed onto itself to provide the support structure. In the present embodiment of the invention, the support structure 22 is formed by a top sheet 24 which is provided with a circular cutout 26 and a bottom sheet 27 which is also circular in form but which is provided with an inner sector shaped cutout 28. The outer margins of the top and bottom sheets 24 and 27 are secured together in a suitable manner such as by heat sealing at 29.

The inner annular margin of the top sheet 24 is secured to a vertically extending ring-like piece or element 31 at 32 which extends in a vertical direction when the support structure 22 is inflated as hereinafter described. The lower margin of the piece or element 31 is heat sealed to a sector-shaped piece or element 34 at 36. The piece or element 34 extends over the bottom sheet 27 and is aligned with the bottom sheet 27 and heat sealed thereon at 37 to provide a sector shaped opening 38.

As can be seen, the sector shaped piece or element 34 in conjunction with the bottom sheet 27 provides a support area in the form of a seat 39 upon which the posterior or buttocks of a human being can be positioned in a seating position with the legs of the human being extending through the opening 38. In order to provide additional rigidity to the seat 41, the sector shaped piece or element 34 is heat sealed to the bottom sheet 27 along parallel lines 42 which extend parallel to the heat sealed seam at 37.

Figure 2:
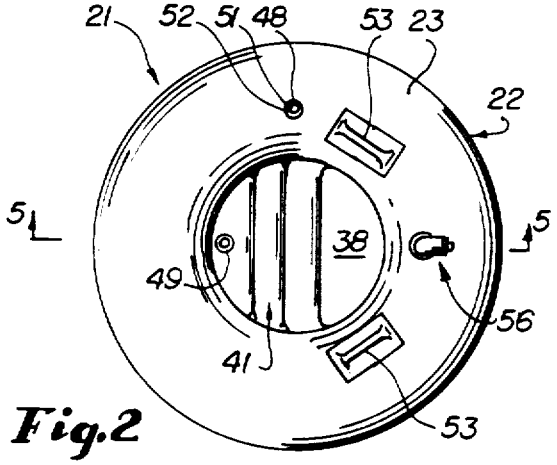
FIG. 2 is a top plan view of the device shown in FIG. 1.

By construction of the support structure in this manner, two separate buoyancy chambers 46 and 47 are provided with the buoyancy chamber 46 being annular in shape whereas the buoyancy chamber 47 is sector-shaped. Means is provided for inflating the chambers 46 and 47 and consists of inflation valves 48 and 49 which can be located in desired positions, as for example, as shown in FIG. 2 in which the valve 48 is in communication with the chamber 46 and the valve 49 is in communication with the chamber 47. The inflation valves 48 and 49 can be of a conventional type as, for example, when plastic is used, the valve can be in the form of a flexible valve stem 51 which can be heat sealed into the top sheet 24. It is of a size so that it is adapted to be grasped by the lips of a human being so that it can be inflated by a human. It is also provided with an attached removable valve plug 52 which can be inserted into the valve stem 51 when the chamber has been inflated to maintain inflation of the chamber. The inflation valve 49 for the seat 41 is constructed in a similar manner.

Typically in order to support an adult, the support structure 22 can have an outside diameter of approximately four feet with the chamber 46 having a vertical dimension of approximately one foot.

If desired, as shown, hand holds can be provided on the top sheet 24 and can be in the form of handles 53 formed of a suitable material such as a solid plastic polyvinyl chloride which are bonded to the top surface of the top sheet 24 in positions adjacent the opening 38 so that they can be grasped by the two hands of a human being or person seated on the seat 41. As can been seen, the handles 53 are directed at angles so that they extend approximately 90° with respect to each other. The handles 53 are generally U-shaped and are provided with generally rectangular openings 54 through which the hands can extend.

Figure 3:
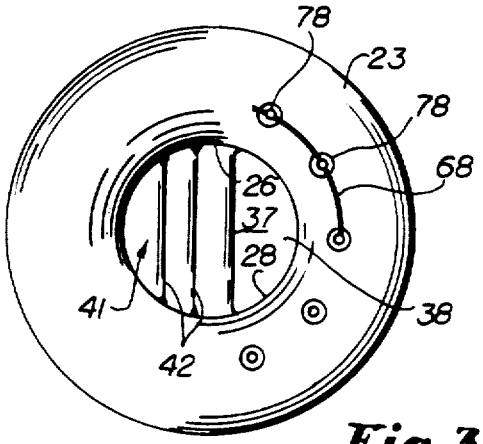
FIG. 3 is a bottom plan view of the device shown in FIG. 1.
Figure 6:
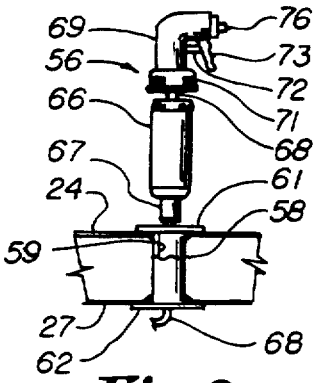
FIG. 6 is a partially exploded view of the squirter shown in the device in FIGS. 1-4.
Figure 8:
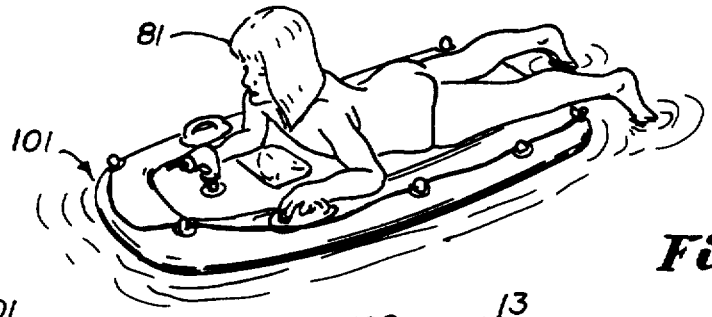
FIG. 8 is a perspective view of another embodiment of an inflatable human support device with liquid squirter incorporating the present invention.

A squirter assembly 56 is mounted upon the support structure 22 in a position so that it can be engaged and operated by the human while the human is being supported on the body of water by the support structure to direct squirts of water from the support structure at a position which is above the surface of the body of water. Thus, as shown in FIGS. 2 and 3, the squirter assembly 56 is mounted on the tubular member 23 in a position which is immediately in front of the opening 38 so that it can be readily grasped by the hand of a human seated on a seat 41. The squirter assembly 56 is mounted in a spool 57 which extends through the tubular member 23. The spool 57 is comprised of a cylindrical member 58 which has a hole 59 extending therethrough. Flanges 61 and 62 are provided on opposite ends of the cylindrical member 58. The spool 57 is adapted to be mounted in a hole 63 provided in the tubular member and has its flanges 61 and 62 resting on the top and bottom sheets 24 and 27 as shown, particularly in FIG. 6.

The squirter assembly 56 is provided with a cylindrical body 66 which can be seated within the hole 59 of the spool 57 and be frictionally retained therein. The lower extremity of the cylindrical body 66 is provided with a cylindrical extension 67 through which the water intake tube 68 extends. The water intake tube 68 is connected to a head 69. The head 69 is provided with a cap 71 which is adapted to be threaded onto the upper extremity of the cylindrical body 66. The head 69 includes a pump assembly (not shown) which is disposed therein. The pump assembly includes an operating member 72 which is connected to a trigger handle 73. The head 69 is provided with a nozzle 76 which is connected to the output of the pump (not shown) operated by the trigger 73. As shown, the nozzle 73 is pointed in a direction so that it can direct a stream of liquid from the pump in a direction which is approximately 90° with respect to the vertical axis of the squirter.

Figure 4:
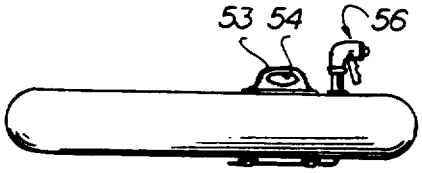
FIG. 4 is a side elevational view of the device shown in FIG. 1.
Figure 5:
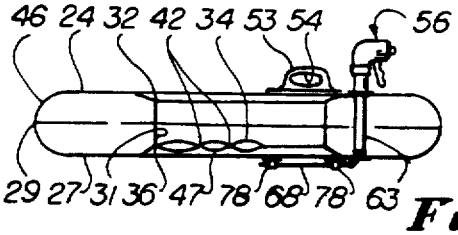
FIG. 5 is a cross sectional view taken along the line 5—5 of FIG. 1.

The liquid or water intake tube 68 can be of a suitable length so that it can take in water as, for example, upon which the support structure 22 is floating. Thus, as shown, particularly in FIGS. 3, 4 and 5, the water intake tube 68 can extend down through the bottom of the hole 63 and extend downwardly into the body of water. In order to ensure that the water intake tube is in an out-of-the way position and does not interfere with the legs of the human using the device, the water intake tube can be retained on the bottom of the support structure, as for example, extending the tubes 68 through spaced apart eyelets 78 formed of a suitable material such as plastic and bonded to the tubular member on the bottom surface of the tubular member. In this way, the squirter assembly 56 can be readily removed from the support structure 22 merely by pulling the cylindrical body 66 out of the spool 57 and withdrawing the tube 68 from the eyelets 78.

Operation and use of the device may now be briefly described as follows. The device can be inflated in the manner hereinbefore described by use of the inflation valves 48 and 49. After the device has been inflated, the device can be placed in a body of water, as for example, in a swimming pool. The tubular member 23 provided for the support structure provides stability on the body of water for the human being. The occupant or user can readily mount or dismount the device. For example, the device could be thrown in the pool and the intended user 81 can jump onto the device and seat himself or herself in the device by becoming seated on the seat 41 and having legs extend through the opening 38 as shown in FIG. 1. Alternatively, the human being 81 can climb onto the device 21 from the swimming pool and sit on the seat 41 with the legs extending through the opening 38. With the feet in this position, the occupant can paddle the feet to move the device from one location to another in the pool. The handles 53 provided on the device makes it possible for the occupant to stabilize himself or herself in the device in the event one bumps into another such device in the same body of water. In addition, water games can be played with the use of the squirter by directing squirts of water at the person in the other device or devices in the pool by actuation of the trigger or handle 73 to operate the pump of the squirter assembly 56. The jets or squirts of water from the squirter assembly 56 can be directed in various directions merely by rotating the squirter assembly within the spool 57. If desired, the squirter assembly can be removed from the spool 57 to give additional freedom in directing the jets or squirts of water from the squirter assembly. The water intake tube 68 is sufficiently long so that its lower extremity will still be below the surface of the body of water so that there is an unlimited source of liquid for operation of the squirter assembly. Thereafter, the squirter assembly can be readily placed in the spool 57 and the water intake tube 68 threaded through the eyelets 78.

Figure 7:
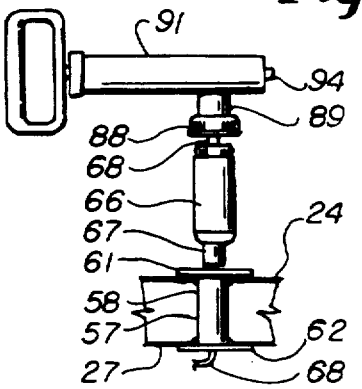
FIG. 7 is a partially exploded view of another embodiment of a squirter which could be utilized with the device shown in FIGS. 1-5.

It should be appreciated that different types of squirter assemblies can be utilized, other than the squirter assembly 56 shown. For example, a squirter assembly 86 such as shown in FIG. 7 can be provided for providing squirts or jets of water which have greater volume and force so that jets or squirts of water can be projected over longer distances. The squirter assembly 86 as shown in FIG. 7 is comprised of a spool 57 and a cylindrical body 66. A head 87 is provided which has a cap 88 that is threadedly mounted on the body 66. The head 87 is provided with a cylindrical member 89 which is connected to a large cylindrical member 91 that extends at right angles thereto. A large pump assembly (not shown) of a conventional type is mounted within the cylinder 91 and is connected to a pump handle 92 which is adapted to be grasped by the hand of a user. By operation of the handle, jets or squirts of water can be ejected from the nozzle 94. The squirter assembly 86 which is shown in FIG. 7 can be utilized in the same manner as the squirter 56. It is of a larger size so that it can be utilized by larger human beings than the squirter 56. It also can be utilized for directing more forceful squirts or jets of water longer distances than with the squirter 56.

Another embodiment of a device for use by a human in a body of water is shown in FIGS. 8-13. As shown therein, the device 101 is comprised of an inflatable support structure 102 in the form of a raft which is adapted to support a human body upon a body of water. It can be formed of a material similar to the support structure 22 as, for example, plastic. Two sheets 103 and 104 cut to the desired conformations can be heat sealed together along the outer margin at 106. Another heat seal can be formed at 107 extending around the perimeter of the sheets 103 and 104 spaced inwardly from 106 to provide a relatively large tubular buoyancy chamber 108 which extends around the outer margin of the support structure 22. An additional rectangular heat seal 109 is provided near the forward extremity of the support structure 22 to provide another buoyancy chamber 111. Another rectangular heat seal is provided at 112 to the rear of the heat seal at 109 with a plurality of spaced parallel heat seals 113 being disposed within the heat seal 112 so that there are provided a plurality of buoyancy chambers or compartments 116. By these heat seals, an additional chamber 117 is provided which extends around the chambers 116 and the chamber 111 and which is disposed within the confines of the chamber 108.

A valve 121 is provided for inflating the chamber 108. A valve 122 is provided for inflating the chamber 117 and a valve 123 is provided for inflating the chambers 116. The valves 121, 122, and 123 are of the type hereinbefore described and are adapted to be inflated by human beings.

The support structure 102 is constructed in such a way so that the main portion of the human body can rest upon the large elongate rectangular support area 126 provided above the chamber 116 to support the main portion of the body. The rectangular support area 127 within the heat seal at 109 can provide support for the head of the body being supported by the support structure.

A pair of handles 131 of the same type as the handles 53 are mounted on the support structure above the chamber 108 on opposite sides of the area 127 and are bonded thereto.

Figure 9:
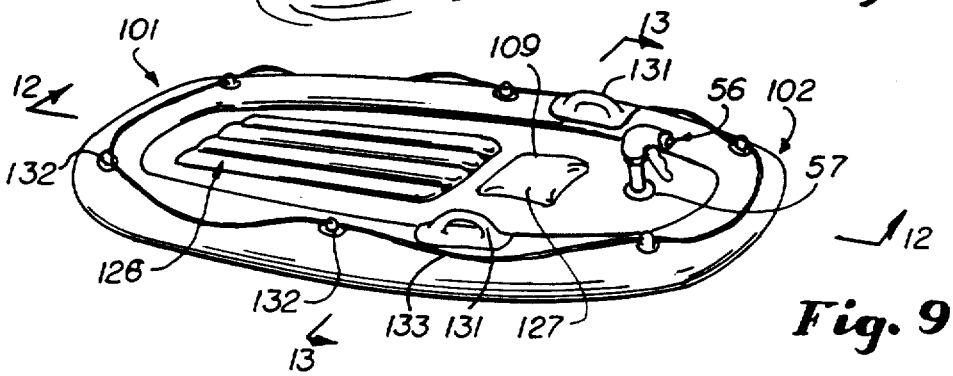
FIG. 9 is an isometric view of the device shown in FIG. 8.
Figure 10:
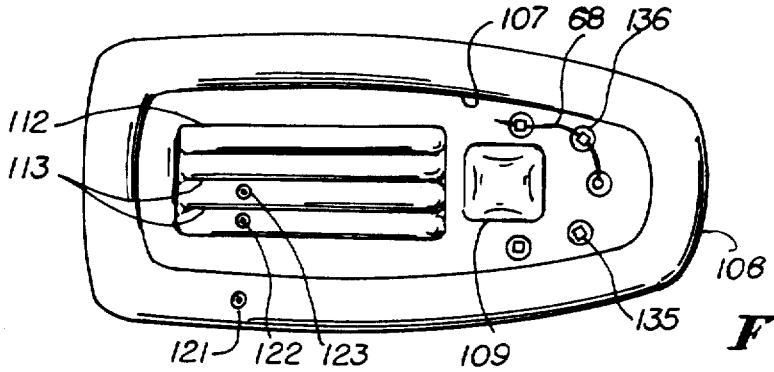
FIG. 10 is a bottom plan view of the device shown in FIGS. 8 and 9.
Figure 11:
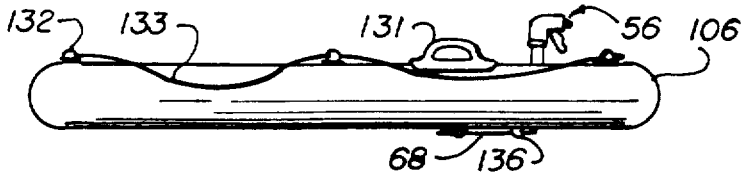
FIG. 11 is a side elevational view of the device shown in FIGS. 8, 9 and 10.
Figure 12:
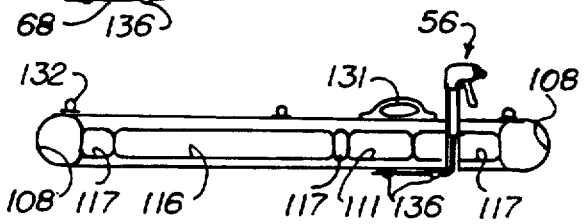
FIG. 12 is a cross sectional view of the device shown in FIGS. 8-10 taken along the line 12—12 of FIG. 9.
Figure 13:
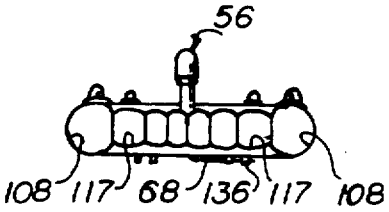
FIG. 13 is a cross sectional view taken along the line 13—13 of FIG. 9.

A plurality of eyelets 132 are also mounted upon the support structure 102 on the top surface thereof and extend around the outer perimeter and are adapted to receive a flexible elongate line or rope 133 which can extend around the outer margin of the support structure 102 as shown, particularly in FIG. 9. This line or rope 133 can be utilized for towing the device or for grabbing the device.

A squirter assembly 56 of the same type as hereinbefore described in the previous embodiment is mounted in a spool 57 provided in the support structure. The water intake tube 26 can be mounted in eyelets 136 provided on the bottom side of the support structure 122 as shown particularly in FIGS. 10 and 11. Again, it can be seen that the water intake tube 26 is disposed in an out-of-the way position underneath the support structure.

The operation and use of the device 101 is similar to the device 21. The principal difference is that in the device 101 the person or human body is normally supported in a reclining or horizontal position with the face facing downwardly and facing forwardly towards the squirter assembly 56. In this manner, the squirter assembly 56 can be readily accessible to a hand of a human so that the trigger 73 can be readily engaged to operate the pump which is provided in the squirter assembly. The squirter can be operated in the same manner as in the previous embodiment. For example, it can be rotated and even lifted out of the spool 57 when desired to achieve the desired trajectory for the jet or squirt of water being ejected therefrom. When the squirter assembly 56 has been removed from the spool, the water intake line will still be in the body of water so that there is available an unlimited source of water for carrying on water play. After use, the squirter assembly 56 can be again reinserted in the spool 57 and the water inlet lines threaded through the eyelets 136.

Figure 14:
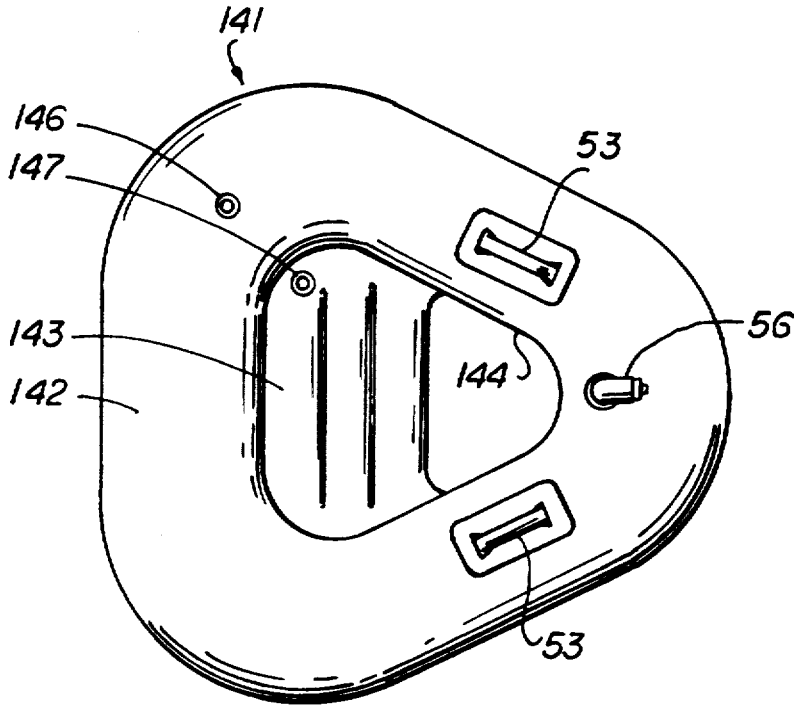
FIGS. 14 and 15 show alternate shapes for the inflatable human support device of the present invention.
Figure 15:
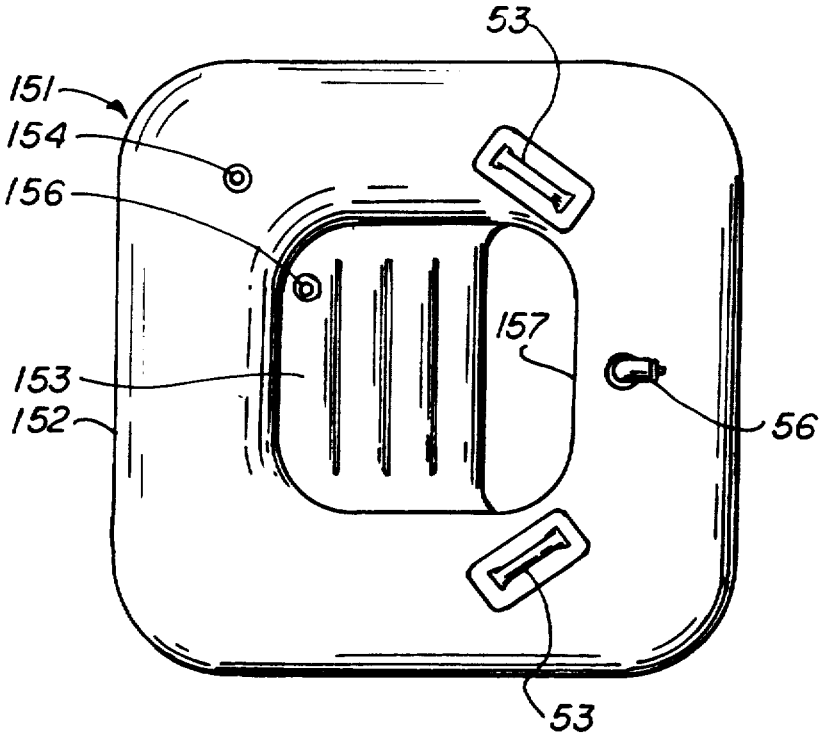

Additional embodiments of the device incorporating the invention are also shown in FIGS. 14 and 15. In FIG. 14, the device 141 has a construction very similar to that shown in the device 21 with the principal difference being that the configuration is generally triangular rather than circular as shown in FIGS. 1-6. It is provided with a tubular member 142, a seat 143 with an opening 144 through which the legs of the person can extend. It is also provided with a pair of handles 53 on opposite sides of the opening 144 and a squirter assembly 56 disposed forwardly of the opening 144. Valves 146 and 147 are provided for inflating the same.

In the device 151 shown in FIG. 15, the configuration is substantially rectangular rather than circular as shown in FIGS. 1-6. It also is provided with a tubular member 152, a seat 153 with valves 154 and 156 for inflating the same. An opening 157 is provided for the legs of the user. A squirter assembly 56 is mounted forwardly of the opening and handles 53 are provided on opposite sides of the opening.

Operation and use of the devices shown in FIGS. 14 and 15 is substantially the same as that described for the embodiment shown in FIGS. 1-6.

From the foregoing, it can be seen that there has been provided for use by humans, devices designed for use in a body of water for water play. The devices are constructed in such a manner so that they can be utilized while being in seated or reclining positions. The devices are constructed in such a manner so that they are safe to use by children. The devices can be readily moved in the body of water, either by paddling the feet in a seated position or by utilizing the arms and feet in a reclining position. At the same time, one of the hands can be utilized for operating the squirter assembly to direct jets of water towards the opponent. It can be seen that the device is readily adapted for group play in which a number of the devices can be utilized in the same pool with human beings, i.e., children, being mounted in the devices for engaging in play. The devices are constructed in such a manner so that they can be formed of relatively inexpensive material at low cost.

What is claimed is:

1. In a device for use by a single human in a body of water, an inflatable support structure, valve means carried by the support structure for inflating the support structure, said support structure when inflated having a buoyancy in water sufficient to support only a single human on the body of water in a sitting position or a reclining face down position, said support structure being formed so that the legs and/or arms of the single human while in a sitting or reclining position can engage the body of water for maneuvering the device from one location to another in the body of water, a water squirter carried by the support structure and having piping means adapted to be disposed in the body of water in a region in the vicinity of the support structure and also including a member adapted to be engaged by the single human for operation of the same, said water squirter being movably positioned on the support structure so that the water squirter can be engaged and operated by the single human and moved through various positions with respect to the support structure while the single human is being supported on the body of water by the support structure so that squirts of water can be directed from the water squirter at various angles above the surface of the water.

2. A device as in claim 1 wherein the squirter assembly is provided with a member adapted to be engaged by the hand of the human being supported by the support structure.

3. In a device for use by a single human in a body of water, an inflatable support structure, valve means carried by the support structure for inflating the support structure, said support structure when inflated having a buoyancy in water sufficient to support only a single human on the body of water in a sitting position or a reclining face down position, said support structure being formed so that the legs and/or arms of the single human while in a sitting or reclining position can engage the body of water for maneuvering the device from one location to another in the body of water, a water squirter carried by the support structure and having piping means adapted to be disposed in the body of water in a region in the vicinity of the support structure and also including a member adapted to be engaged by the single human for operation of the same, said water squirter being positioned on the support structure so that the water squirter can be engaged and operated by the single human and moved through various positioned while the single human is being supported on the body of water by the support structure so that squirts of water can be directed from the water squirter at various angles above the surface of the water, said support structure being comprised of a tubular member which defines substantially all of the periphery of the support structure, said support structure including a support area within the confines of the tubular member for supporting a major portion of the human body.

4. A device as in claim 3 wherein said tubular member is generally circular in plan.

5. A device as in claim 3 wherein said tubular member is generally rectangular in plan.

6. A device as in claim 3 wherein said tubular member is generally triangular in plan.

7. A device as in claim 3 wherein said support area within the tubular member is in the form of an elongate generally rectangular support surface adapted to support a major portion of a human body in a reclining or horizontal position.

8. In a device for use by a single human in a body of water, an inflatable support structure, valve means carried by the support structure for inflating the support structure, said support structure when inflated having a buoyancy in water sufficient to support only a single human on the body of water in a sitting position or a reclining face down position, said support structure being formed so that the legs and/or arms of the single human while in a sitting or reclining position can engage the body of water for maneuvering the device from one location to another in the body of water, a water squirter assembly carried by the support structure and having piping means adapted to be disposed in the body of water in a region in the vicinity of the support structure and also including a member adapted to be engaged by the single human for operation of the same, said water squirter assembly being movably positioned on the support structure so that the water squirter assembly can be engaged and operated by the single human and moved through various positions with respect to the support structure while the single human is being supported on the body of water by the support structure so that squirts of water can be directed from the water squirter assembly at various angles above the surface of the water, said water squirter assembly including a water intake tube which has a length which extends below the surface of the surface of the support structure to permit the squirter to be lifted free of the support structure while having the water inlet tube still be disposed within the body of water.

9. In a device for use by a human being in a body of water, an inflatable support structure when inflated having a buoyancy in water, a water squirter carried by the support structure and having piping means adapted to be disposed in the body of water in a region in the vicinity of the support structure and also including a member adapted to be engaged by the human being for operation of the same, said water squirter assembly being positioned on the support structure so that the water squirter assembly can be engaged and operated by the human being while the human being is in the vicinity of the support structure and being movable so that squirts of water can be directed from the water squirter at various angles above the surface of the water, said water squirter assembly including a water intake tube which has a length which is adapted to extend below the surface of the support structure into the body of water, said water squirter assembly including a sleeve disposed within the support structure and extending therethrough in a generally vertical direction, and a water squirter mounted in the sleeve including a body seated within said sleeve and being rotatable therein to permit rotation of the water squirter to facilitate aiming of the squirts of water form the water squirter.

10. In a device for use by a single human in a body of water, an inflatable flexible ring support structure having a centrally disposed opening therein, valve means carried by the support structure for introducing an inflation medium into the support structure to inflate the same, said support structure when inflated having a buoyancy in water sufficient to support only a single human on the body of water, a water squirter assembly carried by the support structure and having piping means adapted to be disposed in the body of water in a region in the vicinity of the support structure and also including a member adapted to be engaged by the single human for operation of the same, said water squirter being movably positioned on the support structure so that the water squirter can be engaged and operated by the single human and moved relative to the support structure through various positions while the single human is using the support structure on the body of water so that squirts of water can be directed from the water squirter at various angles above the surface of the water and with a sleeve member disposed within the support structure and extending therethrough in a generally vertical direction, said water squirter being removably mounted in said sleeve member.

11. In a device for use by a human in a body of water, an inflatable support structure when inflated having a buoyancy in water, a sleeve member disposed within the support structure and extending therethrough in a generally vertical direction, a water squirter assembly movably mounted in the sleeve member, said squirter assembly including a member adapted to be engaged by the hand of the human using the device for operation of the water squirter assembly, said water squirter assembly having piping means adapted to be disposed in the body of water in the vicinity of the support structure, said water squirter being movable relative to the support structure so that squirts of water can be directed from the water squirter at various angles above the surface of the water.

12. A device as in claim 11, wherein said water squirter assembly includes a body removably seated within said sleeve member and rotatable therein to permit rotation of the squirter assembly to facilitate aiming of the squirts of water from the squirter assembly.

13. A device as in claim 12, wherein said water inlet tube has a length so that when the water squirter assembly is lifted free of the sleeve member, the water inlet tube is still disposed within the body of water.

* * * * *

US005167554B1

REEXAMINATION CERTIFICATE (3629th)

United States Patent [19]

[11] B1 5,167,554

Tager et al.

[45] Certificate Issued Sep. 22, 1998

[54] INFLATABLE HUMAN SUPPORT WITH LIQUID SQUIRTER

[75] Inventors: Leon H. Tager, San Carlos; William R. Storey, Sunnyvale, both of Calif.

[73] Assignee: Poolmaster, Inc., Menlo Park, Calif.

Reexamination Request:
No. 90/004,633, May 14, 1997

Reexamination Certificate for:

| | |
|---|---|
| Patent No.: | **5,167,554** |
| Issued: | **Dec. 1, 1992** |
| Appl. No.: | **683,120** |
| Filed: | **Apr. 3, 1991** |

Related U.S. Application Data

[63] Continuation of Ser. No. 410,916, Sep. 22, 1989, abandoned.

[51] Int. Cl.[6] ..... B63C 9/08

[52] U.S. Cl. ..... 441/131; 222/79; 441/129

[58] Field of Search ..... 114/345; 441/65, 441/66, 40, 129–132; 222/78, 79, 175, 192

[56] References Cited

U.S. PATENT DOCUMENTS

| | | | |
|---|---|---|---|
| 2,562,080 | 7/1951 | Barnes | 441/131 |
| 4,766,918 | 8/1988 | Odekirk | 114/345 |

*Primary Examiner*—Ed Swinehart

[57] ABSTRACT

A device for use by a human in a body of water comprising a support structure having a buoyancy in water sufficient to support a human on the body of water. A water squirter is carried by the support structure and has piping means adapted to be disposed in the body of water in a region in the vicinity of the support structure. The water squirter includes a member adapted to be engaged by the human for operation of the same. The water squirter is positioned on the support structure so that the water squirter can be engaged and operated by the human while the human is being supported on the body of water by the support structure so that squirts of water can be directed from the water squirter at a location which is above the surface of the water.

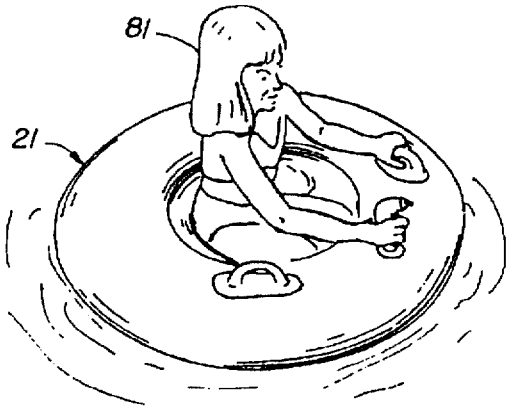

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 4, 7–10, 12 and 13 are cancelled.

Claims 3 and 11 are determined to be patentable as amended.

Claims 5 and 6, dependent on an amended claim, are determined to be patentable.

New claim 14 is added and determined to be patentable.

3. In a device for use by a single human in a body of water, an inflatable support structure, valve means carried by the support structure for inflating the support structure, said support structure when inflated having a buoyancy in water sufficient to support only a single human on the body of water in a sitting position or a reclining face down position, said support structure being formed so that the legs and/or arms of the single human while in a sitting [or reclining] position can engage the body of water for maneuvering the device from one location to another in the body of water, a water squirter *assembly* carried by the support structure and having piping means adapted to be disposed in the body of water in a region in the vicinity of the support structure and also including a member adapted to be engaged by the single human for operation of the same, said water squirter *assembly* being positioned on the support structure so that the water squirter *assembly* can be engaged and operated by the single human and moved through various [positioned] *positions* while the single human is being supported on the body of water by the support structure so that the squirts of water can be directed from the water squirter at various angles above the surface of the water, said support structure being comprised of a tubular member which defines substantially all of the periphery of the support structure *and having an upper surface,* said support structure including a [support area] *seat member* within the confines of the tubular member for supporting [a major portion] *the buttocks* of the human body *and providing a single opening within the confines of the tubular member immediately adjacent the tubular member through which both of the legs of the human body can depend while seated on the seat member, said seat member having at least one buoyancy chamber therein providing additional rigidity for the seat member to support the buttocks, said water squirter being mounted on said upper surface of said tubular member in a region immediately adjacent said single opening to make possible ready access of the water squirter to a hand of the human body while permitting the human body to use its legs for maneuvering the device on the body of water, said water squirter assembly including a water intake tube which has a length which extends below the support structure to permit the water squirter assembly to be lifted free of the support structure while having the water intake tube still being disposed within the body of water.*

11. In a device for use by a human in a body of water, an inflatable support structure when inflated having a buoyancy in water, a sleeve member disposed within the support structure and extending therethrough in a generally vertical direction, a water squirter assembly movably mounted in the sleeve member, said squirter assembly including a member adapted to be engaged by the hand of the human using the device for operation of the water squirter assembly, said water squirter assembly having piping means adapted to be disposed in the body of water in the vicinity of the support structure, said water squirter being movable relative to the support structure so that squirts of water can be directed from the water at various angles above the surface of the water, *said water squirter assembly including a body removably seated within said sleeve member and rotatable therein to permit rotation of the squirter assembly to facilitate aiming of the squirts of water from the squirter assembly, said piping means having a length so that when the water squirter assembly is lifted free of the sleeve member, the piping means is still disposed within the body of water.*

*14. A device as in claim 3 wherein said valve means carried by the support structure for inflating the support structure includes first valve means for inflating the tubular member and second valve means for inflating the seat member.*

* * * * *